US005431399A

United States Patent [19]

Kelley

[11] Patent Number: 5,431,399

[45] Date of Patent: Jul. 11, 1995

[54] CARD SHUFFLING AND DEALING APPARATUS

[75] Inventor: Kalon L. Kelley, Santa Barbara, Calif.

[73] Assignee: MPC Computing, Inc, Santa Barbara, Calif.

[21] Appl. No.: 199,766

[22] Filed: Feb. 22, 1994

[51] Int. Cl.[6] ..... A63F 1/14

[52] U.S. Cl. ..... 273/149 P

[58] Field of Search ..... 273/149 P

[56] References Cited

U.S. PATENT DOCUMENTS 4,534,562 8/1985 Cuff et al. ..... 273/149 P
4,822,050 4/1989 Normand et al. ..... 273/149 P
4,951,950 8/1990 Normand et al. ..... 273/149 P
5,067,713 11/1991 Souales et al. ..... 273/149 P
5,121,921 6/1992 Friedman et al. ..... 273/149 P
5,240,140 8/1993 Huen ..... 273/149 P

*Primary Examiner*—Benjamin H. Layno

[57] ABSTRACT

A playing card distribution device with microprocessor and scanning circuits. The device has an enclosure for holding a deck of cards, a displacement means powered by a motor with one or more friction attachments that come into contact with the bottom card and cause it to be displaced, a set of photocells to sample the card indicia, a processor to use the sampled card indicia to determine in which direction (or to which holding receptacle) the card is to be displaced. Operation of the system is controlled by a combination of preprinted program cards, ordinary playing cards, and microswitches.

13 Claims, 8 Drawing Sheets

*"lateral system"* perspective

*"lateral system"* perspective

*"lateral system"* cutaway

Lateral system - no displacement

Lateral system - maximum displacement

*"four-way"* system perspective

*"four-way"* card transport system

*"four-way"* card transport system

Binary representation of scanned indicia

CARD SHUFFLING AND DEALING APPARATUS

BACKGROUND

1. Field of the Invention

This invention relates to devices for the shuffling and dealing of playing cards.

2. Description of Prior Art

The game of contract bridge is widely played; it is estimated that there are 30 million bridge players in the United States alone. The two principal variants of the game are rubber bridge and duplicate bridge. In rubber bridge the cards are randomly shuffled and distributed to the players each hand; in duplicate bridge the hand that is played has to be preserved (or duplicated) so as to be playable by other players. This allows for comparison of scores that eliminates the "luck of the draw" since comparisons are made between players who have held the identical card distributions.

The present invention is designed to fulfill the following needs:

1. It may be the desire of the participants in a bridge session to constrain the random distribution of cards. For example, they may wish to primarily produce hands that will produce game bids, or hands that favor no-trump bidding, or hands that have unusual distributions, etc. Or they might wish to establish a constraint that both pairs in the game will, over the course of the session, receive approximately the same number of "high cards".

2. In a duplicate bridge environment, the system will allow for the same hands to be played at different tables over the course of the session without any requirement for physically moving cards from one table to another. Information on the hands played may be electronically collected and off loaded to a central computer for tournament scoring and production of individual result summaries.

3. In a teaching environment, hands of pedagogical merit or historical interest can be distributed.

A number of different approaches to fulfilling one or more of the above needs have been proposed. One approach (U.S. Pat. Nos. 4,951,950, 4,534,562—first embodiment, 5,067,713) involves coding a deck of playing cards with bar codes or OCR font, and then inserting the cards one by one into a device that indicates (by illuminated light or other means) to which hand the dealer should manually distribute the card. The requirement for nonstandard (off the shelf) playing cards as well as the manual operation required to determine for each card which hand it belongs to make this approach both slower and more error-prone than the current invention. Other approaches (U.S. Pat. Nos. 4,534,562—second embodiment, 4,822,050, 5,121,921), while still requiting non-standard cards, do proceed automatically through a deck of cards. However the transport mechanism are extended and cumbersome (U.S. Pat. No. 4,822,050) or involve elaborate mechanical gates and tape reader (U.S. Pat. No. 5,121,921), in contrast to the current invention which has a minimum of moving parts. U.S. Pat. No. 4,534,562 (second embodiment) has a gravity fed transport that may have problems with displacement of a card due to the friction between cards as well as not being able to control with any precision the timing of card movement, and the distribution means is extended resulting in a high profile system.

OBJECTS AND ADVANTAGES

Several objects and advantages of the present invention are:

(a) to provide for positive card displacement by action of one or more motors;

(b) to have a mechanically simple displacement mechanism that, in addition to being robust, results in a physically compact and low profile system, this being particularly important if the system is left on a card table in the center during tournament play;

(c) an ability to use computer software discrimination logic so as to be operable with ordinary (non premarked) playing cards;

(d) an ability to distribute the cards directly onto a playing table thus avoiding the need for manually extracting the cards from receptacles and seeing that they get to the appropriate player;

(e) an ability to electronically capture information as to results of hands played thus allowing for automatic scoring and production of individual result summaries;

(f) to provide for operation in a variety of different modalities (e.g., to produce random distributions, or distributions subject to certain constraints, or specific distributions).

DRAWING FIGURES

FIG. 1 is a perspective view of the invention.

FIG. 2 is a cross section view with one side removed and some parts exploded.

Figure 3A:
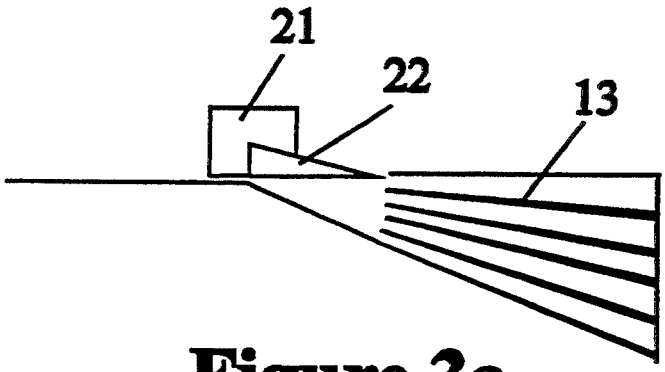

FIG. 3*a* is a cross section view of the displacement cam aligned with the slot that leads into the topmost holding receptacle.

Figure 3B:
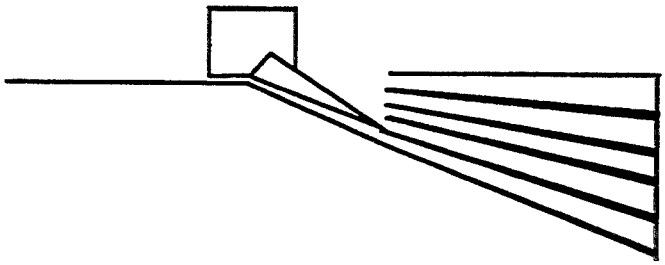

FIG. 3*b* is a cross section view of the displacement cam aligned with the slot that leads into the bottom holding receptacle.

Figure 6:
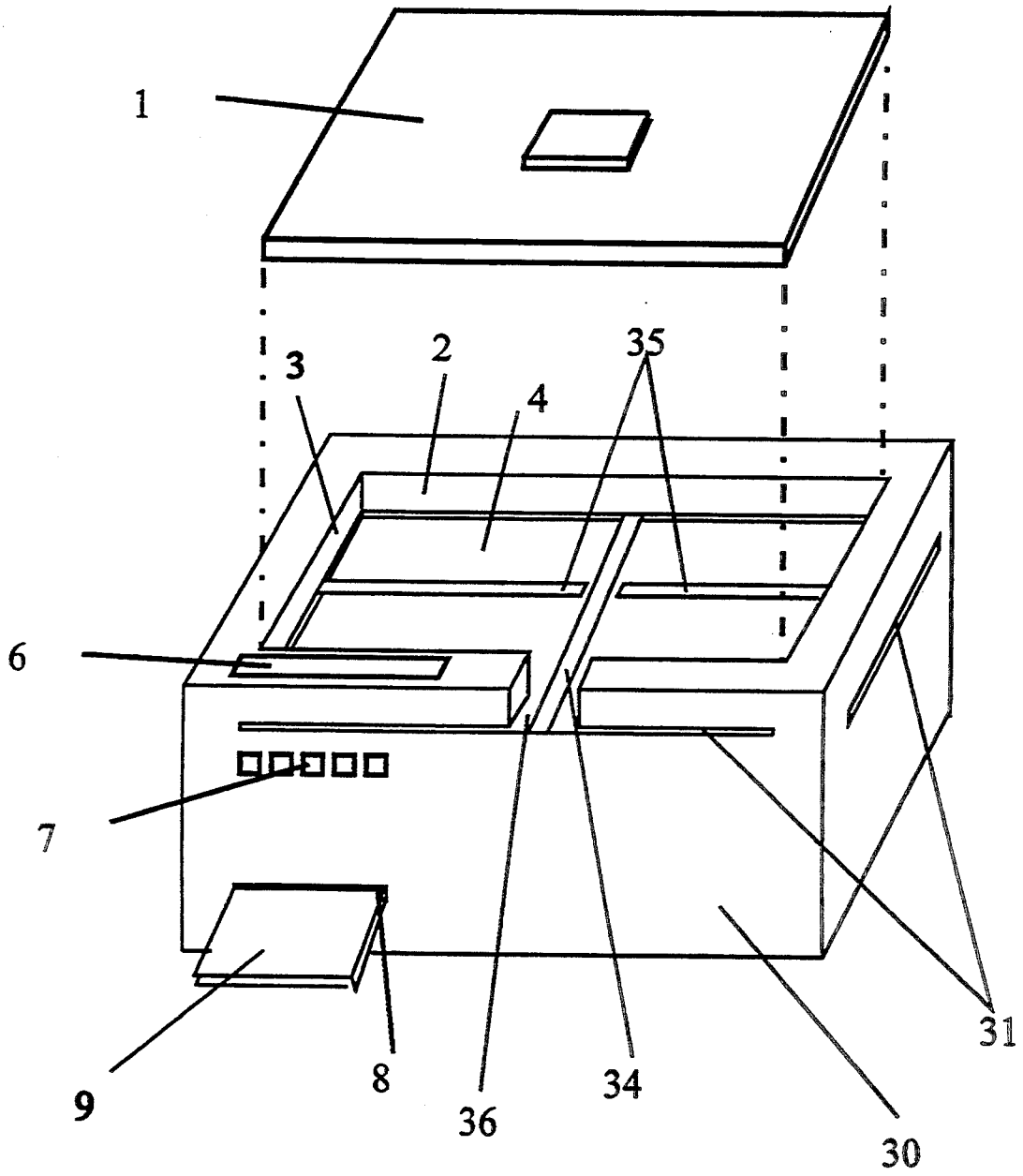
Figure 7:
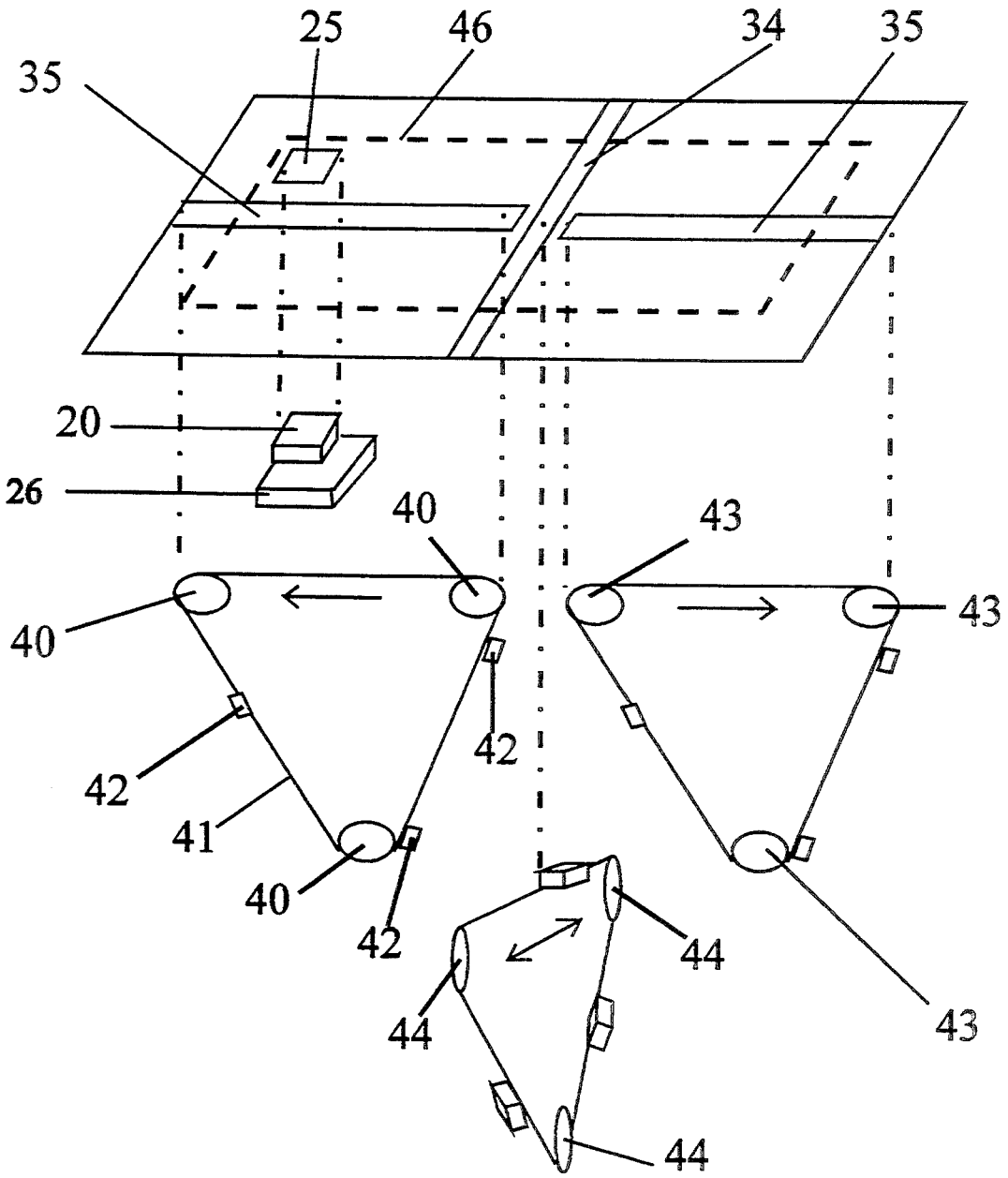
Figure 8:
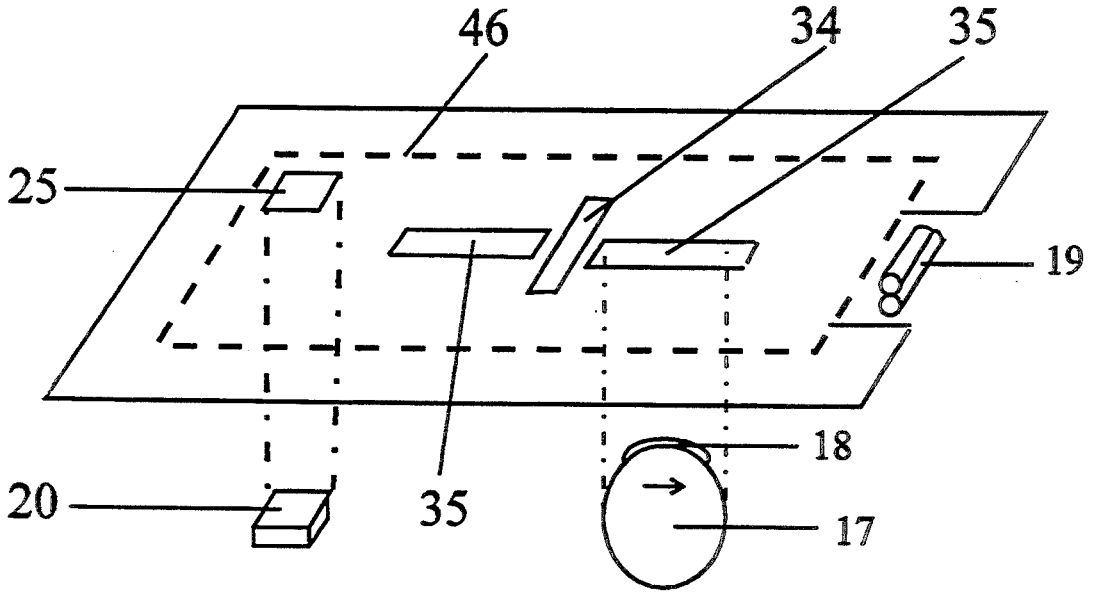

FIGS. 6, 7 and 8 illustrate the four-way form of the invention.

FIG. 6 is a perspective view of the invention.

FIG. 7 is a simplified cross section view that shows one transport mechanism.

FIG. 8 is a simplified cross section view that shows an alternative transport mechanism.

Figure 4:
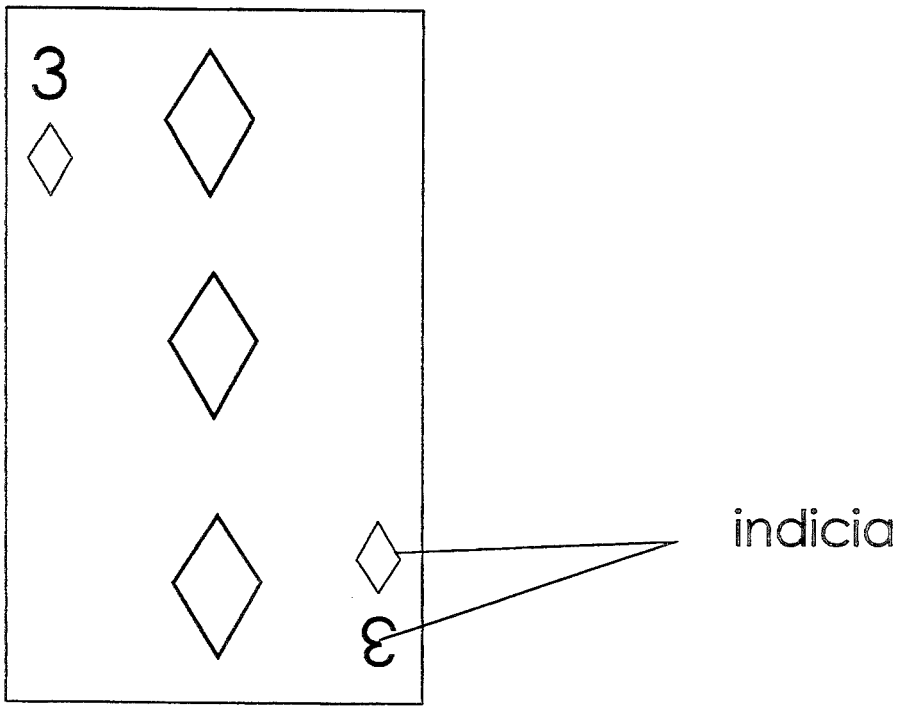

FIG. 4 is the face of an ordinary playing card.

Figure 5:
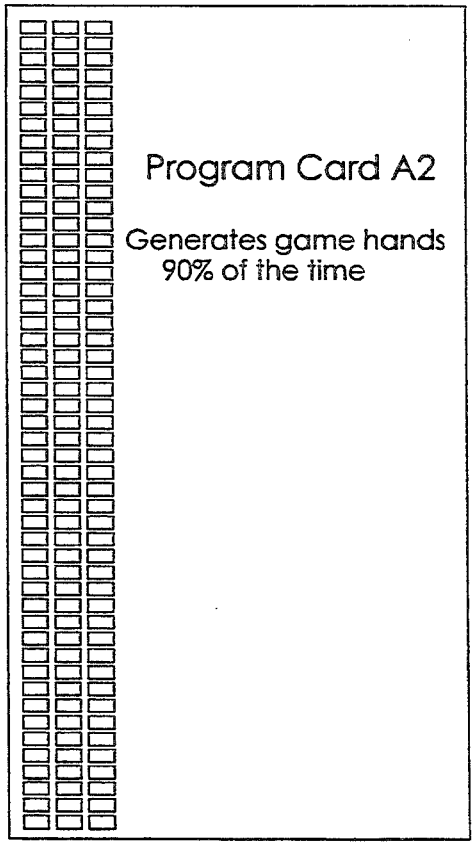

FIG. 5 is the face of a possible program card.

Figure 9:
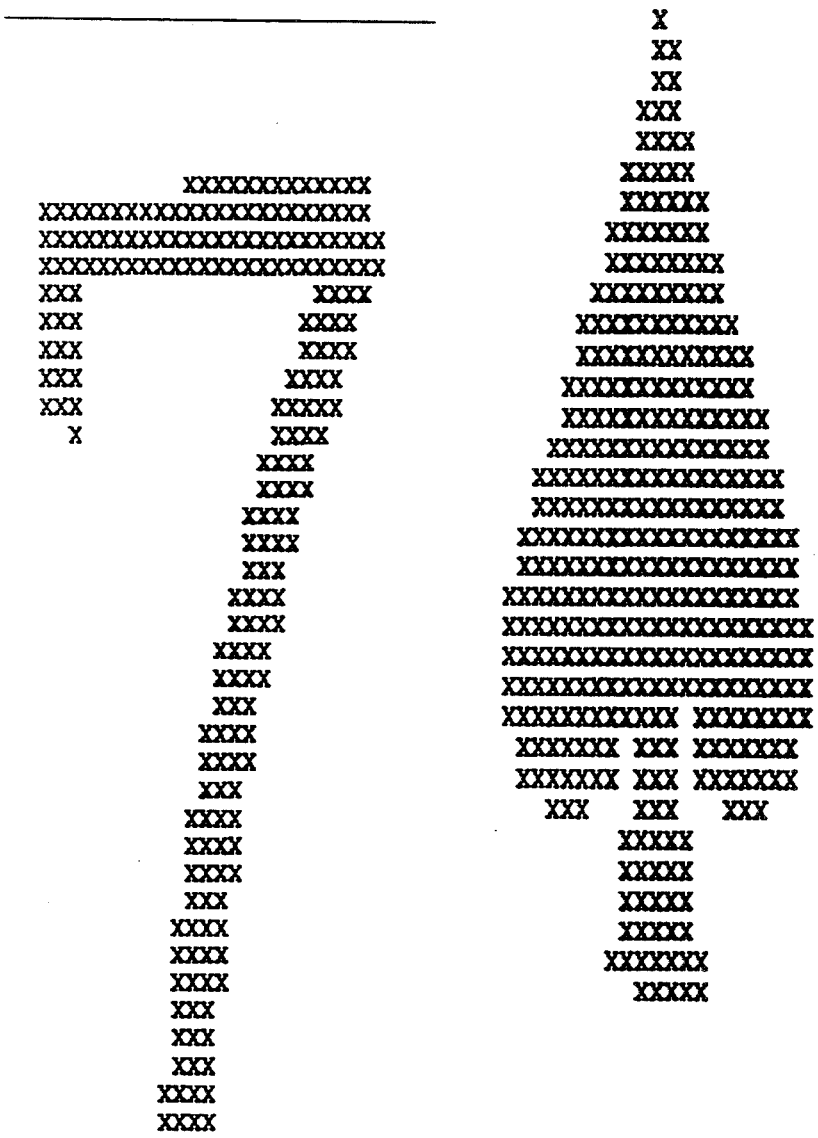

FIG. 9 illustrates what the processor memory might look like after a scan of playing card indicia.

REFERENCE NUMERALS IN DRAWINGS

1 weighted top
2 enclosure side (card length)
3 enclosure side (card width)
4 base of enclosure
5 slot in base (lateral system)
6 display readout
7 micro switches
8 slot for memory card
9 memory card
10 base of holding compartment (lateral system)
11 sides of holding compartment (lateral system)
12 end holding receptacle (lateral system)
13 base holding receptacle (lateral system)
17 wheel
18 frictional component on wheel
19 pinch rollers
20 photocell array 21 displacement motor (lateral system)
22 displacement cam (lateral system)
23 cutaway for pinchrollers (lateral system)
24 interior base (lateral system)
25 cutaway for photocell array
26 processor
27 slit (lateral system)
30 housing (4-way system)
31 slits (4-way system)
34 cutaway horizontal (4-way system)
35 cutaways vertical (4-way system)
36 cutaway for handgrasp (4-way system)
40 pulleys (4-way system)
41 belt (4-way system)
42 frictional member (4-way system)
43 pulleys (4-way system)
44 pulleys (4-way system)
46 dotted line showing enclosure (4-way system)

SUMMARY OF THE INVENTION

The present invention provides a means for (a) shuffling and distributing cards in a random manner, or (b) distributing cards in a predetermined manner. The device is intended to operate with ordinary "bridge-size" cards. In addition to a deck of cards, the system will have a small number of cards called "program" cards. While the same size as ordinary playing cards, these cards are specially encoded so as to indicate to the device in what modality it should operate. For example, one such program card could be an instruction to the device to randomly distribute a deck of cards (hereinafter referred to as the "random" distribution modality). The user would insert into the device an unordered deck of cards with this program card at the bottom. The device would first read the program card; generate internally a random distribution for the hands; and then cause the deck of cards to be distributed appropriately to reflect the desired distribution.

As another example, another program card might be an instruction to generally generate "gamegoing" hands (these are hands where the distribution of high cards is primarily distributed to one pair rather than another, thus allowing them to win most of the tricks). As before, the user would put this program card at the bottom of the deck. The device would read the program card; then generate internally a quasi-random distribution subject to the constraint that the high cards be appropriately allocated to one of the two pairs; and then distribute the cards. We note that the program card need not be passed through the machine each time a new distribution of cards is desired; the modality of the prior distribution will be continued unless overridden by a subsequent program card. (This modality is referred to hereafter as the "restricted" distribution modality).

In addition to distribution along these lines (random or restricted), the other modality can be called predetermined In this case an exact distribution is desired. A program card can be prepared that indicates how every card in a particular hand is to be distributed. That card is placed at the bottom of the deck; the device reads it and then uses that information to distribute the balance of the cards. A variant of this modality is the duplicate bridge game where there would a shuffling/distribution device at each table. In this case it is (generally) not important for particular distributions to be created, but it is important that the totality of hands for the session be identical whenever played (the table at which hands are played, and the pairs playing them will vary). This could be accomplished by "seeding" the random generator for each device to the same value; then whatever hands were generated to constitute the hands for the session would be the same from table to table. Seeding could proceed by following a "seeding" program card with a randomly mixed set (or subset) of playing cards; the sequence of those cards would establish an initial value for the random generation function. After being read by one device, the seeding program card and randomly mixed set of playing cards could be moved to another machine, and the process repeated there. Alternatively, the removable memory means in the device could be programmed with the desired distributions prior to the start of the session.

After the system determines a desired distribution the system operates to distribute the cards. Two embodiments of the current invention are described herein: (a) the four-way system, and (b) the lateral system.

In the four-way system the indicia (suit and rank indicators) or code (if special encoding is used) on the bottom card in the deck are read statically (without movement of the card) by an array of photocells. The processor determines how that card should be distributed. The appropriate drive motor is then energized which brings into contact on the base of the card a friction pad that engages the card and displaces it some portion of its length (if it is being displaced along its length dimension) or width (if it is being displaced along its width dimension). As the drive motor continues another friction pad comes into contact with the card and continues the displacement. After several such displacements the card exits the housing and falls to the table.

In the lateral system a motor is energized (and stays energized during the duration of dealing all the cards) and the bottom card in the deck engaged by a friction pad which displaces it. As the card exits the holding receptacle it passes over an array of photocells that reads the indicia (or code) on the card. The processor then determines into what holding tray the card should be directed. The card is further propelled laterally by a pinch roller that directs it into a distribution chute that is attached to a stepping motor. The processor advances the stepping motor so as to align the distribution chute with the desired holding tray, and the motive force of the pinch roller acting on the card propels it into that holding tray.

DETAILED DESCRIPTION OF THE INVENTION

In one of the two forms of the invention chosen for purposes of illustration in the drawing (the four-way system), FIG. 6 shows an exterior perspective. Side walls 2 and 3 form an enclosure that is deep enough to hold a deck of playing cards. (The dimensions of a standard sized playing card are $2\frac{1}{4}$ inches wide by $3\frac{1}{2}$ inches long. There is a break 36 in one of the side walls to allow for manual removal of the card deck should that be necessary. The housing 30 is rectangular in shape and somewhat larger than a playing card in both width and length. The base of the enclosure 4 that holds the playing cards has three slots 34 and 35 in it. Slot 34 extends from one side of the housing to the other side of the housing along the width dimension of a playing card. Slots 35 extend from about the midpoint of the enclosure to one side of the housing along the length dimension of a playing card. The base of the enclosure 4 also extends to the exterior wall of the housing 30. The housing itself is constructed so as to have four small slits 31 above the base in all four sides of the housing. A card could be placed in the enclosure and then slid in any of four directions through a slit and thus outside the housing.

A weighted top 1 would be placed above the deck of cards in the enclosure to ensure that the bottom card was sufficiently flat so as to be displaceable through one of the slits 31, which slits are only wide enough to allow a single card to pass through.

Several switches 7 are accessible and can be used to initiate card dealing and to enter information into the system as to contract and result. There is also a small visual display 6 that can be used for indicating facts about the hand (dealer, vulnerability, board number) as well as for validating information that the user may enter with the switches 7.

In a duplicate bridge environment, it may be desirable for the system to accumulate information about the hands that are played, and then at the end of the session transfer that information to a central computer where the tournament results could be computed. A means for accomplishing this would be a removable memory card 9 (such as a PCMCIA memory card) that could be inserted or extracted from slot 8 to connect with the processor. At the end of a session it could be extracted and used to transfer result information to a central computer. In the alternative that card could be a modem for wireless transmission of results to a central computer.

FIG. 7 is an exploded drawing that shows the base of the enclosure that holds the cards along with the drive apparatus that resides beneath that base. Dotted rectangle 46 is there only to show the boundaries of the enclosure that holds the cards. This view has the same orientation as FIG. 6; that is a card in the receptacle is positioned face down so that its length extends over the major portion of the two slots 35. The width of the card extends over the major portion of slot 34. The base of the receptacle has a small cutaway 25 in one of the corners of the receptacle, under which is positioned an array of photo sensors 20. These photo sensors can read the indicia (the rank and suit indicators) on an ordinary playing card or, in the alternative, cards that are premarked with a bar coding to indicate rank and suit. After the card has been read, the processor 26 (which has memory for storage of a matrix of values from the photocell array) determines in which of the four directions the card should be displaced. For illustration, assume it is to be displaced along its length dimension to the left in FIG. 7. A motor is energized which drives a belt 41 around several pulleys 40. On that belt (which in this case is moving in a counterclockwise direction as shown by the arrow in FIG. 7) are attached several frictional components 42. The belt is aligned underneath the left slot 35. As a frictional component moves into position underneath a slot it extends through and slightly above that slot coming into contact with the bottom card. As the belt moves the card is partially displaced by the frictional component through a slit 31 (FIG. 6). As the belt continues to move a second frictional component enters the slot and continues the lateral displacement of the card, and this process continues until the card is fully displaced through a slit 31. The card then falls on the table (or into a holding receptacle that could be attached to the exterior of the device). The motor is then deenergized and the process repeated for the next card.

If the card was to be displaced to the right as shown in FIG. 7, the motor transport to the right would be energized. This belt system moves in a clockwise direction over pulleys 43 and causes card displacement to the right.

Perpendicular to these two transport systems and between them is a third system that, when the motor is energized drives the belt over pulleys 44 moving cards widthwise rather than lengthwise, and discharges a card from one of the two sides. Which direction the motor moves depends upon the polarity of the current applied to the motor by the processor. The belt and frictional components for this system lie underneath the lateral slot 34.

Various alternative displacement means are consistent with this four-way distribution system. In FIG. 8, the slots 34 and 35 have been shortened and do not extend beyond the boundary of the enclosure. The means that displaces a card now consists of two components. There is a wheel 17 attached to a motor (not shown), which wheel has a frictional protuberance 18 attached to a portion of the wheel. This wheel is attached to the underside of the enclosure base and is positioned so that only when the frictional protuberance 18 is on the top of the wheel is there any part of the wheel and protuberance combination that extends upwards through cutout 35 to come into contact with a playing card in the enclosure. And there is a pinch roller 19 with an upper and lower surface, which rollers are on an axle attached to a motor (axles and motor not shown). For illustration, assume the card is to be displaced along its length dimension to the right in FIG. 8. The motor that drives wheel 17 is energized and moves one revolution in a clockwise direction. As the wheel rotates it brings the frictional protuberance 18 around in a clockwise direction and up through the cutout 35 into contact with a playing card. As the wheel continues its motion the frictional protuberance maintains contact with the card and displaces that card a portion of its length to the right. As the card leaves the enclosure and enters the slit it comes into contact with the pinch rollers 19. These pinch rollers have been energized (with the top roller moving counterclockwise and the bottom roller moving clockwise) and the card enters between them. These pinch rollers continue the displacement of the card outside of the housing where it falls to the table. (A similar system of wheels and pinch rollers for displacement of a card in any of the other three directions is not shown in FIG. 8.)

Figure 1:
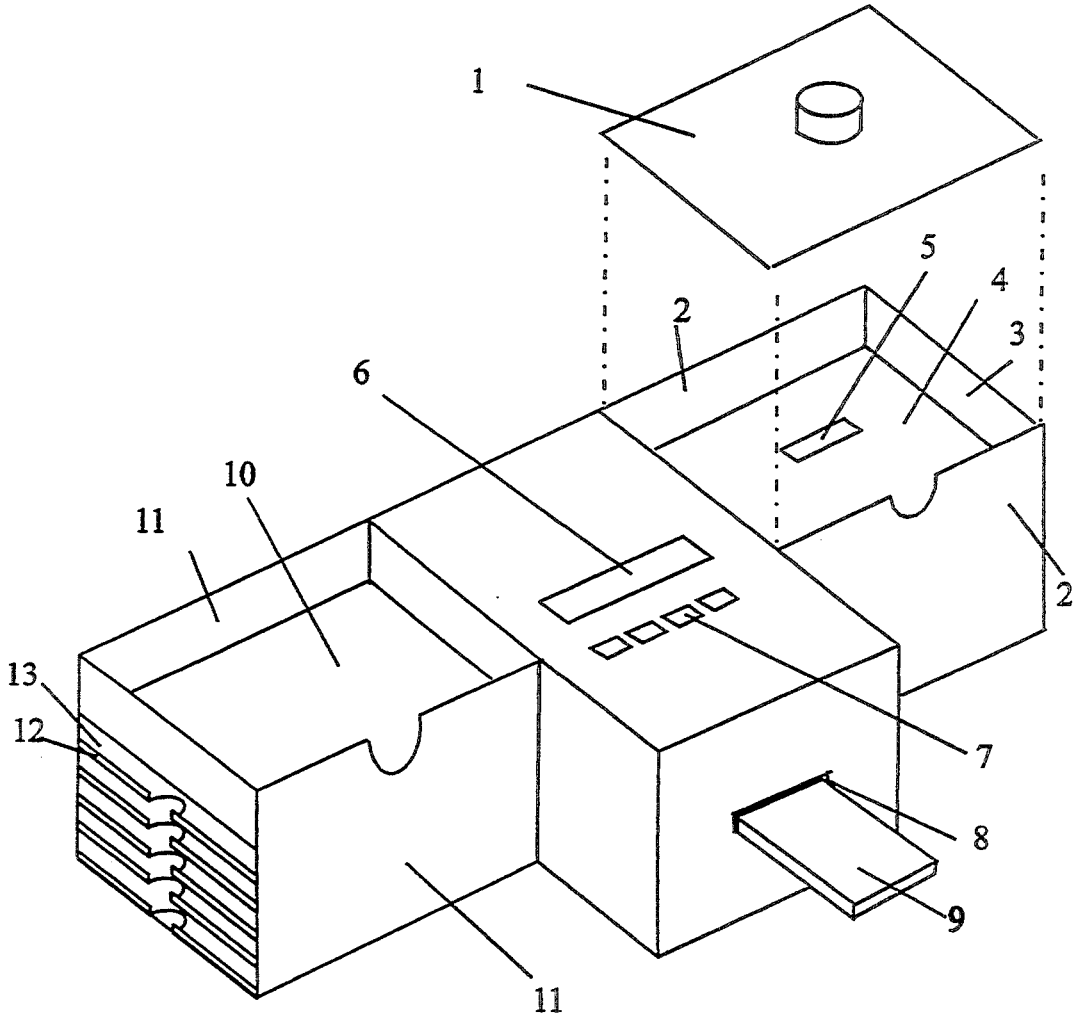
FIGS. 1, 2 and 3 illustrate the lateral form of the invention.

In the other form of the invention chosen for purposes of illustration in the drawings (the lateral system), FIG. 1 shows an exterior perspective. Side walls 2 and 3 form an enclosure that is deep enough to hold a deck of playing cards. The length of side 3 is approximately the width of a card; the length of side 2 is approximately the length of a card which thus establishes how the cards are oriented in the device. Side 2 has a cutaway so as to allow removal of the cards placed in the enclosure if necessary. The enclosure has a removable weighted top 1 that when placed on top of a deck of cards provides a downward pressure on the deck of cards. 5 is a slot in the base of the enclosure through which a contact means can engage the bottom card of the deck to cause its horizontal displacement. The device is shown with a holding compartment with sides 11 and base 10 for temporary storage of a card deck or program cards. Underneath this compartment are five holding receptacles with notched base 13 and end 12 to hold the cards after they pass through the device. Several switches 7 are accessible and can be used to initiate card dealing and to enter information into the system as to contract and result. There is also a small visual display 6 that can be used for indicating facts about the hand (dealer, vulnerability, board number) as well as for validating information that the user may enter with the switches 7.

In a duplicate bridge environment, it may be desirable for the system to accumulate information about the hands that are played, and then at the end of the session transfer that information to a central computer where the tournament results could be computed. A means for accomplishing this would be an optional removable memory card 9 (for example, a PCMCIA memory card) that could be inserted or extracted from slot 8 to connect with the processor. At the end of a session it could be extracted and used to transfer result information to a central computer. As an alternative that card could be a modem for wireless transmission of results to a central computer.

Figure 2:
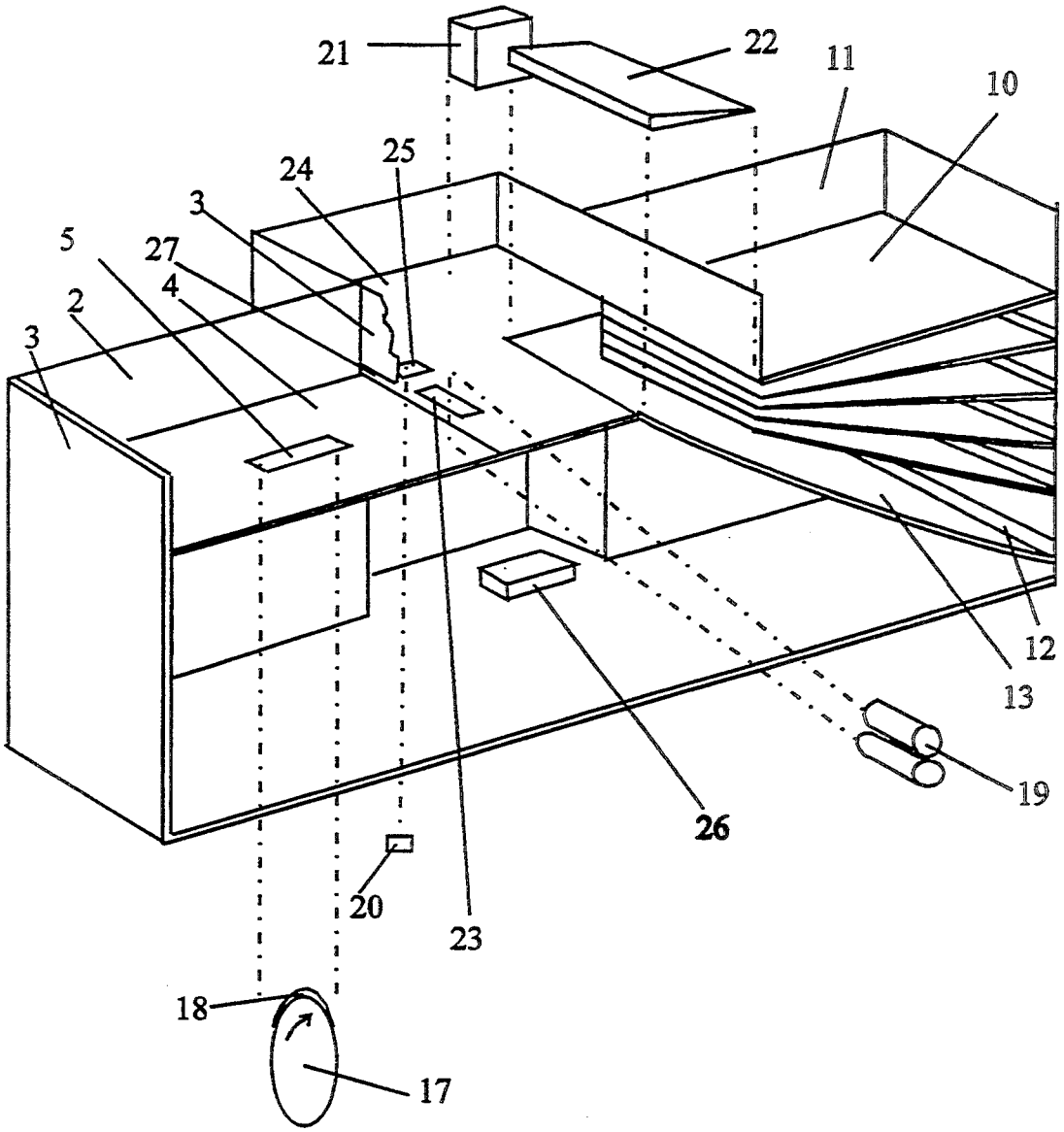

FIGS. 2 and 3 show the interior components of the device. The means that displaces a card consists of three components. There is a wheel 17 attached to a motor (not shown), which wheel has a frictional protuberance 18 attached to a portion of the wheel. This wheel is attached to the underside of the enclosure base and is positioned so that only when the frictional protuberance 18 is on the top of the wheel is there any part of the wheel and protuberance combination that extends upwards through cutout 5 to come into contact with a playing card in the enclosure. There is a pinch roller 19 with an upper and lower surface, which rollers are on an axle attached to a motor (axles and motor not shown). And there is a displacement cam 22 attached to a stepping motor 21.

When the device is started, the motor that turns wheel 17 is energized and moves in a clockwise direction. As the wheel rotates it brings the frictional protuberance 18 around in a clockwise direction and up through the cutout 5 into contact with a playing card. As the wheel continues its motion the frictional protuberance maintains contact with the card and displaces that card a portion of its length to the right. As the card leaves the enclosure it passes through a slit 27, this being a small space between end wall 3 and enclosure base 4. On the other side of end wall 3 there is a cutout 23 in the base 24. Positioned in that cutout 23 is a pinch roller 19, positioned so that the top roller is above base 24 and the lower roller is below; where the two rollers come together is aligned horizontally with slit 9. As the playing card exits the slit 27 it enters between the two rollers of the pinch roller which continues the lateral displacement initiated by wheel 17. There is an additional cutout 25 in base 24, under which is positioned an array of photo sensors 20. These photo sensors can read the indicia (the rank and suit indicators) on an ordinary playing card or, in the alternative, cards that are premarked with a machine-readable code to indicate rank and suit. After the processor 26 (which has memory for storage of a matrix of values from the photocell array) determines the card indicia, it can then activate stepping motor 21 to rotate the displacement cam 22. The displacement cam has five discrete positions. In one position (as shown in FIG. 3*a*), the under surface of the cam is aligned with the top of the slot that leads into the topmost holding receptacle. In this position the card simply passes across base 24 and into the topmost slot without being affected by the displacement cam at all. If the displacement cam had been rotated one position, the under surface of the cam would be aligned with the top of the slot that leads into the second from the top holding receptacle. In this position the card passes across base 24 and is slightly deflected downwards into the second holding receptacle. FIG. 3*b* shows the displacement cam in its fully rotated position where the under surface of the cam is aligned with the top of the bottom slot that leads into the bottom holding receptacle.

When the deck has been fully distributed, the cards can be manually withdrawn from the receptacles by lifting the accumulated cards up slightly through the notched bottom 13 and over the end wall 12.

Operation of the device is controlled by a microprocessor. The modality of operation (random, restricted or predetermined distribution) is established either by placing at the bottom of the deck of cards when first read a program card (FIG. 5), or by manual entry through the external micro switches, or by information conveyed to the processor via the external memory store. A program card is identical in size to a playing card, but has preprinted black rectangles which the photocells can read. This program card establishes how the card deck should be distributed. The program card is displaced to the bottom receptacle, this being reserved for program cards and any playing cards that are unreadable.

Various alternative displacement means are consistent with this lateral distribution system. For example, as an alternative to the wheel with frictional component and pinch rollers, the system could have a slot that extended the length of the base of the enclosure. Underneath that slot could be a belt to which is attached at least one frictional component. This component would come into contact with the card at its leftmost end (as viewed in FIG. 2) and displace the card a full card length to the right with enough momentum so that the card would continue into the appropriate holding receptacle. Another alternative would be to provide a top and a bottom to the displacement cam 22 so that the card is more positively controlled as it passes into the appropriate holding receptacle.

In either embodiment of this invention (four-way or lateral), the system can operate either by reading playing cards that are specially coded (e.g., with bar codes, OCR fonts), or by reading the ordinary indicia that are printed on played cards. As there is variability among manufacturers in the form in which the indicia are printed, the means for reading those indicia must be able to deal with considerable variation. Also, if the photocell array is sampled periodically as the card moves (as in the lateral embodiment), the speed of that movement is not precise, and the means will need to deal with variability caused by imprecision as to precisely where on a playing card the photocell array is reading. Following is an outline of the means for decoding indicia information.

An $n \times m$ matrix is read from the photocells, where n is the number of horizontally arranged photocells (the rows in the matrix) and m the number of vertically arranged photocells (the columns in the matrix). (In the lateral embodiment, there may only be one row of photocells, but since those photocells are sampled a number of times as the card indicia passes over the array, in this case m would be the number of distinct samplings. ) An entry in the matrix will consist of a binary 0 or 1, a 1 indicating presence of printing (whether black or red, the two colors used in printing of card indicia), and a 0 absence (some reflectivity threshold will be established; a photocell value above that threshold will be mapped into a binary 1, and below that value into a binary 0). (Hereafter, for purposes of discussion and because of the presentation in FIG. 9, binary 0 is referred to as a space or white space, and a binary 1 as an X.)

All rows at the beginning of the matrix that are all spaces are discarded up until the first row that contains at least one X; similarly all rows at the end of the matrix that follow the last row containing at least one X are discarded. FIG. 9 illustrates one matrix for the rank indicator "7" and suit indicator "spades".

The system then computes a number of binary "features" for a given matrix. As these features are described below, the ranks (2 through 10, J(ack),Q(ueen),-K(ing),A(ce)) for which that feature would normally have a positive value are listed in parentheses. In what follows the term "component" is used to describe a pattern that consists of contiguous X's surrounded by white space. Described first is the means for determining rank, and then later the means for determining suit (there will be one or more rows of all white space between the rank and the suit to distinguish them.)

1. Presence of "hanging descender" on the left side of the pattern (2,3,7). This feature is positive if the pattern begins (processing data from the top of the indicia to the bottom) with a positive component that is on the left half of the pattern and that extends for a distance not more than ½ way through the total matrix and then ends (surrounded by white space). In FIG. 9, for example, the "7" has an initial component (the first 4 rows) followed by two components, one to left that is 6 rows long and one to the right that extends the full length of the pattern. Since the left component is less than ½ the length of the total matrix and does not connect to anything, it is a "hanging descender".

2. Presence of "hanging descender" on the right side of the pattern (5,6). This feature is positive if the patterns begins with a positive component that is the right side of the pattern and that extends for a distance not more than ½ way through the total matrix and then ends.

3. Presence of "hanging ascender" on the left side of the pattern (3,5,9,J). This feature is positive if the pattern ends (processing data in sequence in this case from the bottom of the rank indication to the top) with a positive component that is on the left half of the pattern and that extends for a distance not more than ½ way through the total matrix and then ends (surrounded by white space).

4. Presence of "hanging ascender" on the right side of the pattern (2). This feature is positive if the pattern ends with a positive component that is on the right half of the pattern and that extends for a distance not more than ½ way through the total matrix and then ends (surrounded by white space).

After features 1 through 4 are computed, any hanging descenders or ascenders are eliminated from the matrix to simplify the computation of the remaining features.

5. A pattern that has two distinct components at the top (10,K). This feature is positive if the pattern begins with two components.

6. At least one enclosure (A,4,6,8,9,10,Q). This feature is positive if the pattern has at least one component that divides into two components and then recombines, thus creating an enclosed hole.

7. Enclosure is less than 80% in length of the total matrix (A,4,6,8,9). This feature is positive if feature 6 was positive and the dimension of the enclosure is less than 80% of the total length of the pattern.

8. The pattern has a single component moving from right to left (processing rows from the top down) that is at least 60% in length of the total matrix (2,7). This feature is positive if there is a single component that moves from right to left (in terms of columns) as the matrix is processed from top to bottom, which component is at least 60% of the total length of the pattern.

9. The pattern has a vertical component that is at least 90% of the total matrix (4,10,J,K). This feature is positive if there is a continuous vertical component whose length is at least 90% of the length of the pattern.

10. The pattern has a single descending component from the top that is on the right side of the pattern (2,3,7). This feature is positive if there is a single descending component from the top that begins on the right half of the matrix.

11. The pattern has a single ascender from the base on the right side of the pattern (3,5,9,J). This feature is positive if there is a single ascending component from the bottom that begins on the right half of the matrix.

12. At least two enclosures (8). Same logic as in feature 6 but occurs twice.

13. Pattern ends with at least two distinct components (A,10,K). This feature is positive if the pattern has at least two components at its base.

14. For patterns with two components at the top, the rightmost component joins with the leftmost component (K).

A value for each of the above features has now been computed by the processor. To determine the rank, a comparison is made between those values and, for each possible rank, the expected set of values for those features. The rank that has the highest percentage of matching features is taken to be the rank of the playing card.

To determine the suit of a playing card, the system looks at the left boundaries of the suit indicator. If that border goes from its origin to the left over at least 75% of the length of the matrix, it is a spade. If that border goes from its origin to the right over at least 75% of the length of the matrix, it is a heart. If that border goes from its origin to the left over at least ⅓ of the length of the matrix, and then reverses direction and goes to the right over at least ⅓ of the length of the matrix, it is a diamond. If that border goes from its origin to the left and then to the right and then to the left (at least as far as the distance it originally moved to the left), it is a club.

Should the system be unable to determine rank or suit within a predetermined level of confidence, an error code will be displayed on the system display and operation halted.

In duplicate bridge there are different types of information that would be useful to capture with the system for later transfer to a central computer. The information collected for transfer could include (a) the contract and result, (b) the actual bidding sequence used, and (c) the actual play of the hand. The contract and result could be entered into the system through the external switches. If it was desired to capture the actual bidding sequence, the players could use special program cards (for example, in place of verbally announcing a bid like "two spades", the player would select a program card with that designation and display it to the other players. Those program cards could then be put in front of the deck that is assembled at the end of play of that hand for insertion into the distribution device: the system could then read those cards and store the bidding sequence before it started distributing the playing cards for the next hand. And the actual play of the hand could be automatically captured if the players chose to play the hand "duplicate style" (that is, playing a card in front of each player in turn rather than combining all of the cards into a single trick that is taken by the winning team). Once played, if each player maintained the order of the tricks taken, the hands could be combined, the cards cut, and then reentered into the machine for distribution for the next hand. The system could reconstruct from the sequence in which the cards were entered (knowing the contract) the exact sequence of play. The technique used here is elaborated in the following paragraph.

Assume that each player maintains the order of the cards that they have played. The hands are then gathered together, the player order being irrelevant. At this point the deck looks something like this (reading from top down): E13 (the 13th card that the East player played), E12 (the 12th card that the East player played), . . . , E1, S13 (the 13th card that the South player played), S12, . . . , S1, N13, (the 13th card that the North player played), N12, . . . , N1, W13, ..., W1. The cards are then cut by removing an arbitrary number of cards from the bottom of the deck and placing them on the top of the deck. The order might now be: S7, S6, . . . S1, N13, . . . N1, W13, . . . , W1, E13, . . . , E1, S13, . . . S8. This is the order of the cards when the deck is inserted for the next deal. Since the processor determined the distribution of this hand, it knows to which player the cards were dealt, and it is easy to recognize that, in this case, the South cards have been split (tricks 7 through 1 on the top of the deck and 13 through 8 at the bottom). It is now possible, knowing the contract, to completely reconstruct the play of the hand, even to the point of identifying a revoke (failure to follow suit). For example, if E was the declarer at a spade contract, the sequence of play to the first trick will be S1, W1, N1, E1 (the person playing first is always the player to the left of the declarer). The person playing the highest card in the suit lead or the highest trump will win that first trick and will then become the leader for the second trick. Being able to capture this information and make it available to contestants after the bridge session has the potential for considerably altering the nature of tournament bridge; such information has never been available except in some very specific team play situations where it is captured manually. All of the information captured by the distribution system could be transferred to a central computer for producing quite detailed individual analyses.

The game of contract bridge has been used throughout this description to illustrate the advantages and operation of this invention; however this is not intended to limit the application of the invention to that game. The invention could be used in any game where automatic dealing was desired, and particularly when the desired distribution of cards was less than fully random.

The present invention may be embodied in other specific forms without departing from the spirit or essential attributes thereof and, accordingly, reference should be made to the appended claims, rather than to the foregoing specifications, as indicating the scope of the invention.

I claim:

1. An apparatus for automatically dealing playing cards in a predetermined pattern, comprising:

(a) a plurality of playing cards each having indicia or code information thereon corresponding to rank and suit, (b) an enclosure for placing one or more playing cards therein;

(c) said enclosure is contained within a housing, (d) a base of said enclosure having one or more slots, each slot sized for displacing a playing card therethrough, (e) means for reading the indicia or code on a playing card, (f) a processor for processing said indicia or code information and by matching said indicia or code information against the predetermined pattern, and activating a card displacement means for displacing the card in one of a plurality of possible directions, (g) card displacement means for displacing a single card at the bottom of the deck by bringing one or more moving frictional components in contact with the bottom card through one of the slots in the base of the enclosure.

2. The apparatus of claim 1 wherein the slots in the base of the card enclosure extend beyond said enclosure, thus allowing the card displacement means to remain in frictional contact with a card beyond the boundary of said enclosure to ensure that the card is fully discharged from said enclosure.

3. The apparatus of claim 1 wherein the card enclosure has four slits allowing for displacement of a card from said enclosure in any one of four directions.

4. The apparatus of claim 1 wherein the means for reading the indicia uses a photocell array and computer processor for identifying the rank and suit of an ordinary playing card, by using a program comprising the following steps of:

(a) the output signals from said photocell array are stored in a memory matrix of said computer processor, possibly simplified by conversion to a binary pattern to reflect signal values from the photocells above a certain predesignated threshold value, (b) extraction of a set of features from the rank indicia by applying predefined logic tests to values from the memory matrix, (c) determining for each possible rank the percentage of matching features by comparing the features extracted in (b) to features associated with that rank, (d) selecting the rank with the highest percentage of matching features as determining the rank of the playing card, (e) accessing a further memory matrix of said computer processor to apply predefined logic tests to the values obtained by scanning the suit designation, and selecting as the suit of the playing card the suit defined by the results of those logic tests.

5. The apparatus of claim 1 wherein there are pinch rollers adjacent to the card enclosure to provide the motive force for discharging a card.

6. The apparatus of claim 1 wherein the displacement means consists of a plurality of highly frictional members attached to a belt.

7. The apparatus of claim 1 wherein there is a means for entering of contract and result data with the use of a combination of switches, specially marked program cards, and the playing cards; and the retention of that information in a memory means for subsequent transfer to a central scoring system.

8. An apparatus for automatically dealing playing cards in a predetermined pattern, comprising:

(a) a plurality of playing cards each having indicia or code information thereon corresponding to rank and suit, (b) an enclosure for placing one or more playing cards therein, (c) a stationary base of said enclosure having a slot sized for displacing a playing card therethrough, (d) a plurality of holding receptacles adjacent said enclosure for holding playing cards, (e) a means for reading the indicia or code on the playing card, (f) a card displacement means for moving a single card at the bottom of a deck past the reading means, consisting of a means that brings a frictional component in contact with the card to be displaced through a slot in the base of a housing thus engaging the card and displacing it laterally as the frictional component itself moves laterally, (g) a processor for processing said indicia or code information read by the reading means to determine which holding receptacle should receive the card, (h) a distribution means for directing the playing card into a designated holding receptacle.

9. The apparatus of claim 8 wherein the slot in the base of the card enclosure extends beyond said enclosure, thus allowing the card displacement means to remain in frictional contact with a card beyond the boundary of said enclosure to ensure that the card is fully discharged from said enclosure.

10. The apparatus of claim 8 wherein the means for reading the indicia uses a photocell array and computer processor for identifying the rank and suit of an ordinary playing card, by using a program comprising the following steps of:

(a) the output signals from said photocell array are stored in a memory matrix of said computer processor, simplified by conversion to a binary pattern to reflect signal values from the photocells above a certain predesignated threshold value, (b) extraction of a set of features from the rank indicia by applying predefined logic tests to values from the memory matrix, (c) determining for each possible rank the percentage of matching features by comparing the features extracted in (b) to features associated with that rank, (d) selecting the rank with the highest percentage of matching features as determining the rank of the playing card, (e) accessing a further memory matrix of said computer processor to apply predefined logic tests to the values obtained by scanning the suit designation, and selecting as the suit of the playing card the suit defined by the results of those logic tests.

11. The apparatus of claim 8 wherein there are pinch rollers adjacent to the card enclosure to provide the motive force for discharging a card past the distribution means and into a holding receptacle.

12. The apparatus of claim 8 wherein the displacement means consists of a plurality of highly frictional members attached to a belt.

13. The apparatus of claim 8 wherein there is a means for entering of contract and result data with the use of a combination of switches, specially marked program cards, and the playing cards; and the retention of that information in a memory means for subsequent transfer to a central scoring system.

* * * * *